US005951364A

United States Patent [19]

Brown et al.

[11] Patent Number: 5,951,364

[45] Date of Patent: Sep. 14, 1999

[54] BRASSIERE HAVING PANELS FORMING STRAPS

[76] Inventors: Rosie Brown; Tonya A. Brown, both of 7643 S. Paxton Ave., Chicago, Ill. 60649

[21] Appl. No.: 09/067,265

[22] Filed: Apr. 27, 1998

[51] Int. Cl.[6] ..... A41B 9/00; A41C 3/00

[52] U.S. Cl. ..... 450/1; 450/5; 450/79; 450/85; 450/86; 2/109

[58] Field of Search ..... 450/1, 3, 5, 36, 450/79, 85, 86, 88; 2/104, 106, 109, 110, 121, 67; D2/706, 707, 708, 840, 848, 797

[56] References Cited

U.S. PATENT DOCUMENTS

| | | | |
|---|---|---|---|
| 1,337,224 | 4/1920 | Havens . | |
| 1,362,027 | 12/1920 | Miller . | |
| 1,394,235 | 10/1921 | Tate-Smith . | |
| 1,567,793 | 12/1925 | Ferris . | |
| 1,848,536 | 3/1932 | Messman . | |
| 1,886,049 | 11/1932 | Rothblum . | |
| 2,104,943 | 1/1938 | D'Achon . | |
| 2,121,088 | 6/1938 | La Rue . | |
| 2,372,855 | 4/1945 | Reid . | |
| 2,402,835 | 6/1946 | Nagy . | |
| 2,521,373 | 9/1950 | Hutchinson . | |
| 2,638,595 | 5/1953 | Goebel . | |
| 2,753,563 | 7/1956 | Blitch . | |
| 3,094,724 | 6/1963 | Lerner . | |
| 3,465,754 | 9/1969 | Lockwood et al. . | |
| 3,837,049 | 9/1974 | Corrado | 24/201 CF |
| 4,781,651 | 11/1988 | Ekins . | |
| 4,917,651 | 4/1990 | Rainville | 450/58 |
| 5,032,104 | 7/1991 | Rainville | 450/58 |
| 5,098,331 | 3/1992 | Corrado . | |
| 5,149,293 | 9/1992 | Gable . | |
| 5,171,182 | 12/1992 | Heinen | 450/74 |
| 5,427,562 | 6/1995 | Hwang | 450/58 |

*Primary Examiner*—John J. Calvert
*Assistant Examiner*—Shirra L. Jenkins
*Attorney, Agent, or Firm*—David L. Volk

[57] ABSTRACT

A brassiere comprises a pair of cups, a pair of shoulder straps, and a pair of body straps adapted to cross each other, to extend around sides of a person wearing the brassiere, and to fasten to each other at distal ends of the body straps. The shoulder straps and the body straps include hook and loop fasteners for fastening the straps about the person wearing the brassiere.

3 Claims, 5 Drawing Sheets

BRASSIERE HAVING PANELS FORMING STRAPS

BACKGROUND OF THE INVENTION

1. Field of the Invention

The present invention relates to clothing, particularly to brassieres.

2. Description of the Related Art

The prior art contains many brassiere designs. Persons with arthritis or other problems with mobility often have difficulty fastening and unfastening brassieres. Even persons without mobility problems often find the fasteners of conventional brassieres to be cumbersome.

What is needed is a brassiere which fastens and fits securely, providing adequate support for the chest and lower torso, while being easily fastened and unfastened.

SUMMARY OF THE INVENTION

The brassiere of the present invention includes a pair of cups, a pair of shoulder straps, and a pair of body straps adapted to cross each other, to extend around sides of a person wearing the brassiere, and to fasten to each other at distal ends of the body straps. The shoulder straps and the body straps include hook and loop fasteners for fastening the straps about the person wearing the brassiere.

Because the fasteners are hook and loop type, the brassiere is easily secured to and released from the body. Because the body straps cross each other, extend around sides of a person wearing the brassiere, and fasten to each other at distal ends of the body straps, the brassiere fits securely and provides good support for the lower torso.

Still further features and advantages will become apparent from the ensuing description and drawings.

DETAILED DESCRIPTION

Figure 1:
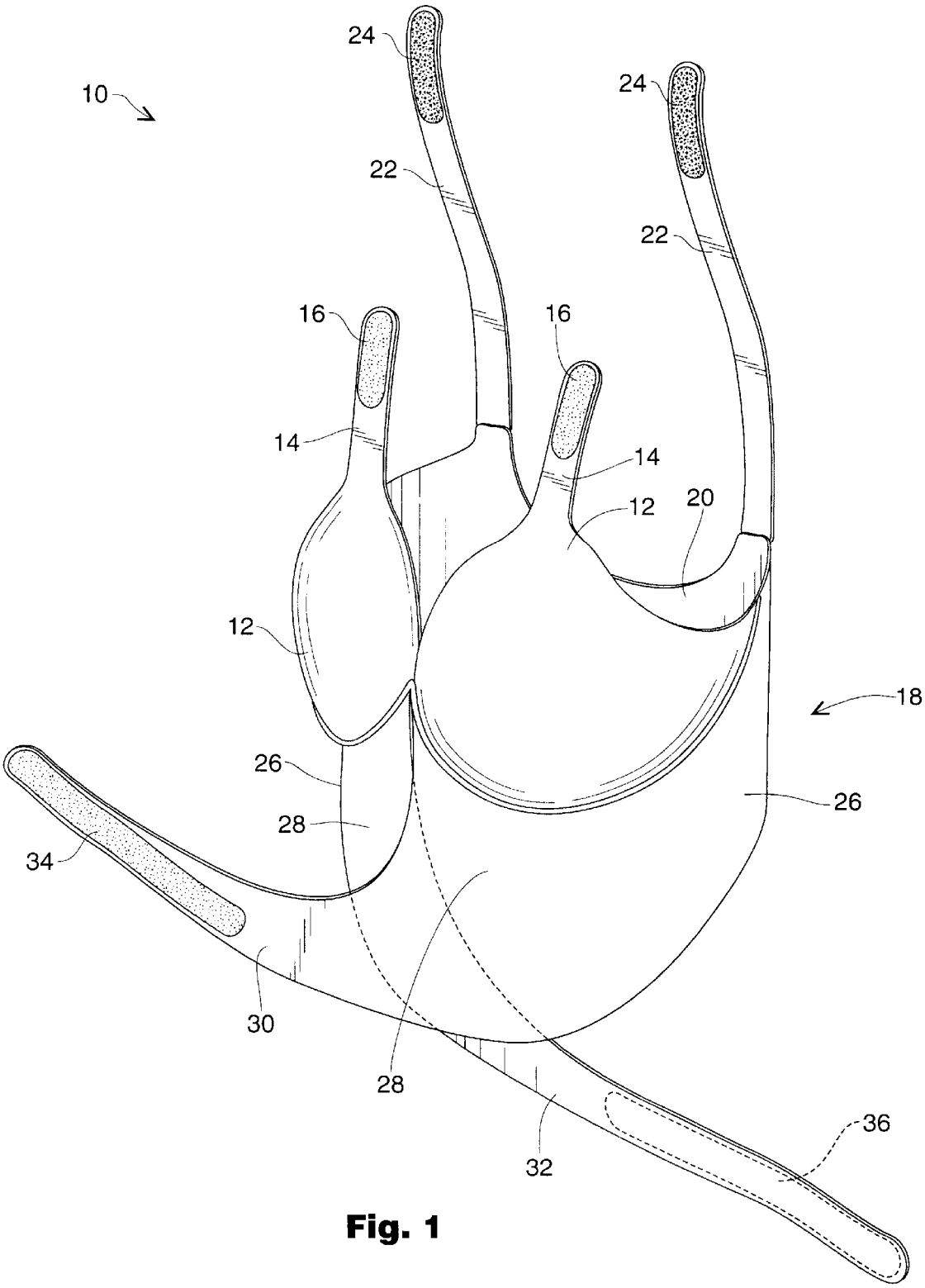
FIG. 1 is a front perspective view of a brassiere of the present invention in an unfastened condition.
Figure 2:
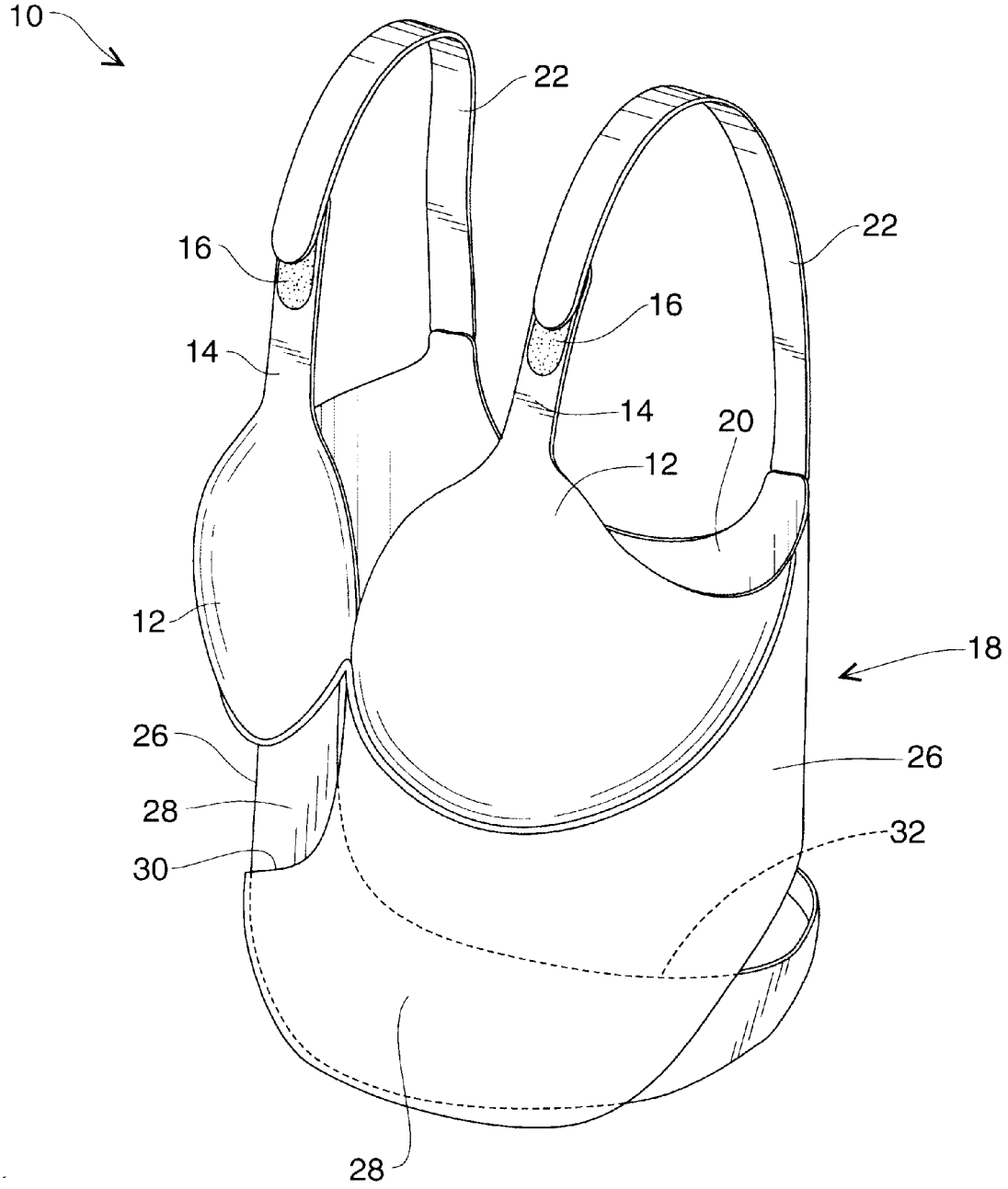
FIG. 2 is a front perspective view of the brassiere in a fastened condition.
Figure 3:
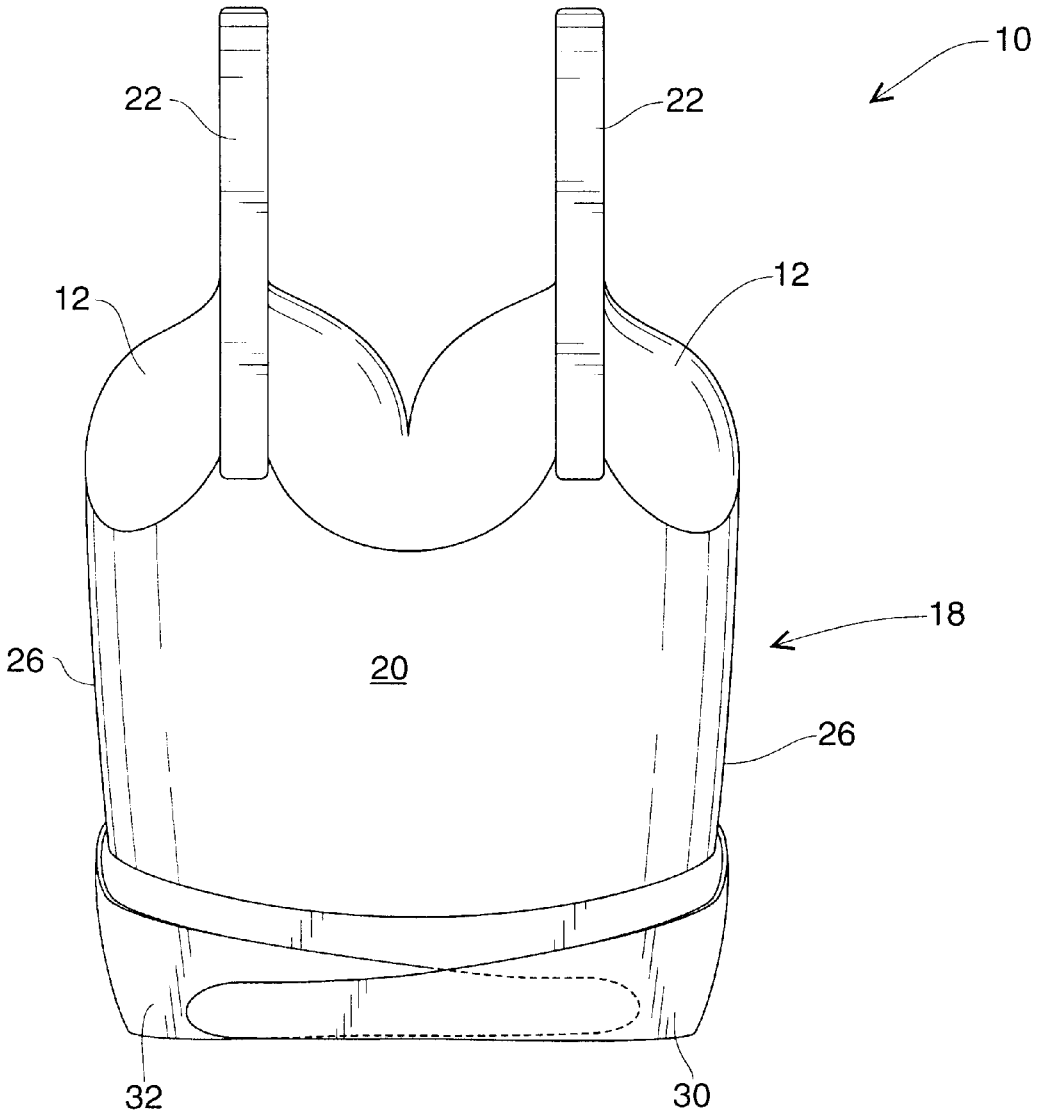
FIG. 3 is a rear elevational view of the brassiere.

FIG. 1 is a front perspective view of a brassiere 10 in an unfastened condition. FIG. 2 is a front perspective view of the brassiere 10 in a fastened condition. FIG. 3 is a rear elevational view of the brassiere 10. Referring to FIGS. 1–3, the brassiere 10 comprises a pair of cups 12 arranged in a conventional manner. Each of the cups 12 includes a first strap member 14 extending upward from the cup 12, and a hook and loop fastener first portion 16 attached to a distal end of the first strap member 14.

A torso support member 18 includes a back panel 20. A pair of second strap members 22 extend upward from the back panel 20. Each of the second strap members 22 has a hook and loop fastener second portion 24 attached to a distal end thereof. The hook and loop fastener first portions 16 are releasably fastenable to the hook and loop fastener second portions 24. The first and second strap members 14, 22 thus form releasably fastenable shoulder straps.

The torso support member 18 includes a pair of side panels 26 extending away from the back panel 20. The torso support member 18 further includes a pair of front panels 28. Each of the front panels 28 extends away from a different one of the side panels 26. Each of the front panels 28 extends downward from a different one of the cups 12.

A first one of the front panels 28 narrows to form a third strap member 30. A second one of the front panels 28 narrows to form a fourth strap member 32. The third strap member 30 is directed toward the second one of the front panels 28, and the fourth strap member 32 is directed toward the first one of the front panels 28.

A second hook and loop fastener first portion 34 is attached to a distal end of the third strap member 30. A second hook and loop fastener second portion 36 is attached to a distal end of the fourth strap member 32. The second hook and loop fastener first and second portions 34, 36 are releasably fastenable to each other. The third and the fourth strap members 30, 32 are adapted to cross each other and to extend around the torso support member 18 until the second hook and loop fastener first and second portions 34, 36 are attachable to each other behind a person (not shown) wearing the brassiere 10.

Figure 4:
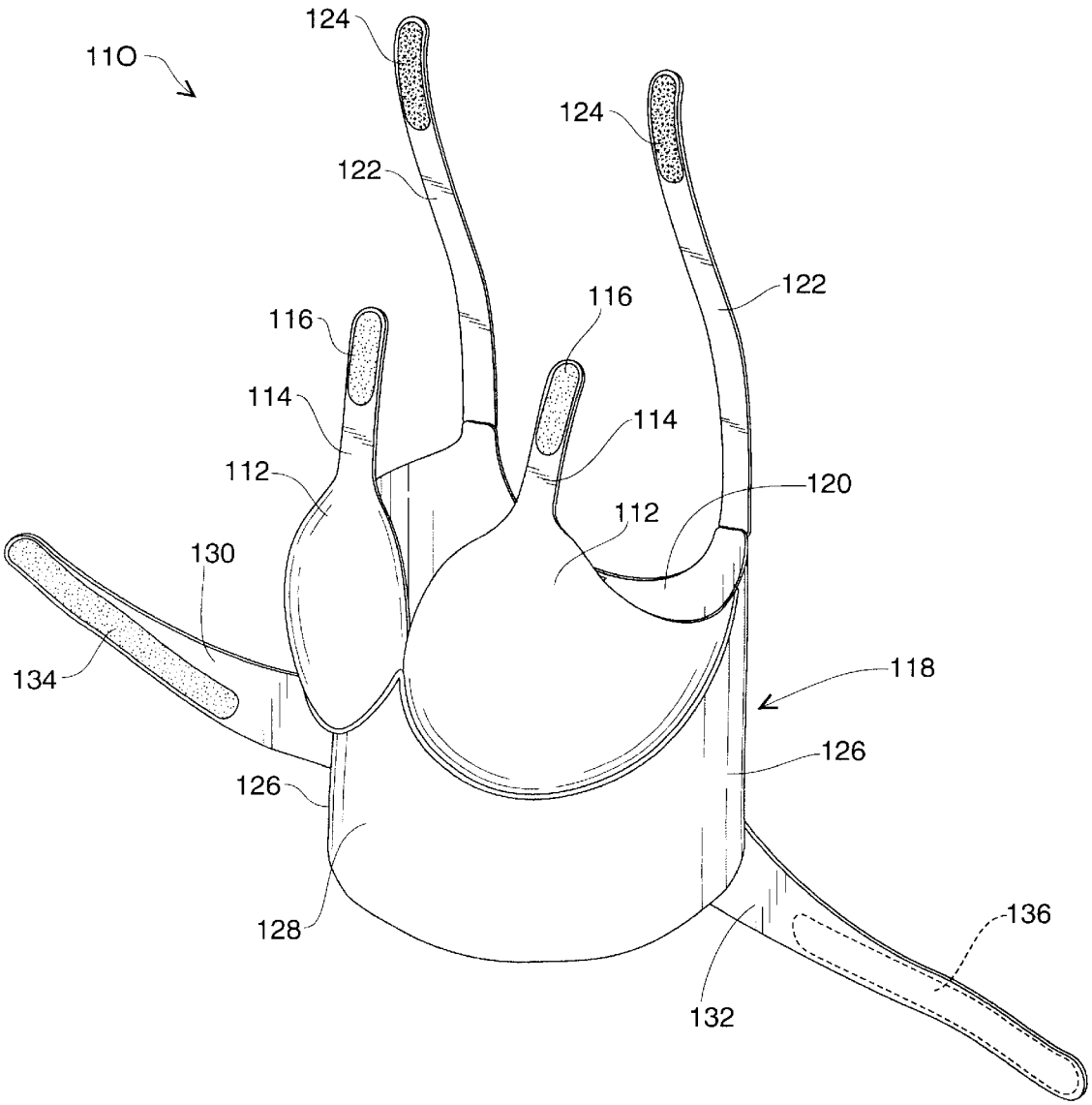
FIG. 4 is a front perspective view of a second embodiment of the brassiere.
Figure 5:
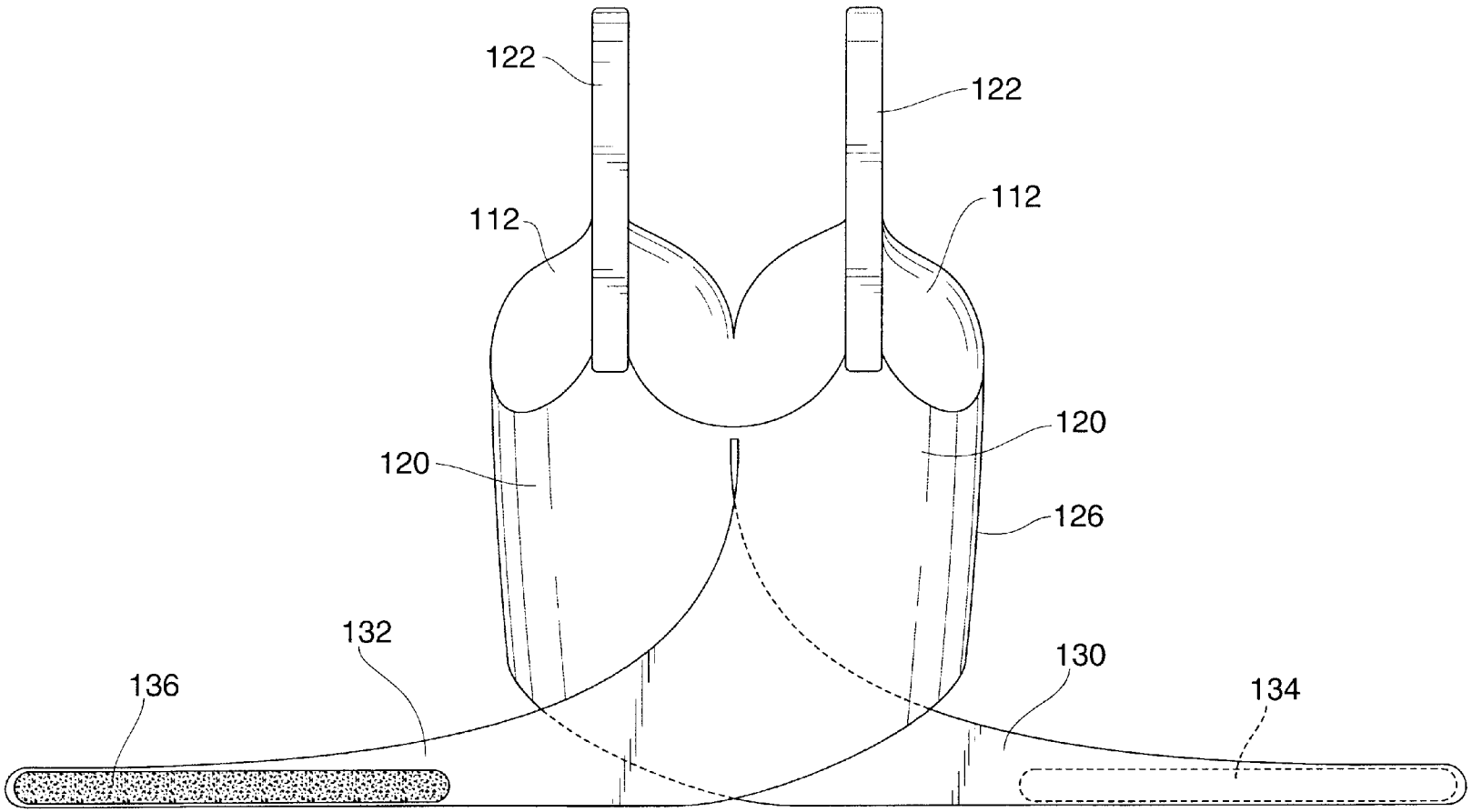
FIG. 5 is a rear elevational view of the brassiere.

FIG. 4 is a front perspective view of a second embodiment of the brassiere 110. FIG. 5 is a rear elevational view of the brassiere 110. Referring to FIGS. 4–5, the brassiere 110 comprises a pair of cups 112, first strap members 114, a pair of second strap members 122, and hook and loop fastener first and second portions 116, 124 arranged as for the previously described embodiment.

A torso support member 118 comprises a pair of back panels 120, and a front panel 128 extending between side panels 126 and extending downward from the cups 112. A first one of the back panels 120 narrows to form a third strap member 130. A second one of the back panels 120 narrows to form a fourth strap member 132. The third strap member 130 is directed toward the second one of the back panels 120, and the fourth strap member 132 is directed toward the first one of the back panels 120.

A second hook and loop fastener first portion 134 is attached to a distal end of the third strap member 130. A second hook and loop fastener second portion 136 is attached to a distal end of the fourth strap member 132. The second hook and loop fastener first and second portions 134, 136 are releasably fastenable to each other.

In a manner similar to the first embodiment of the brassiere 10, as shown in FIG. 3, the third and the fourth strap members 130, 132 are adapted to cross each other and to extend around the torso support member 118 until the second hook and loop fastener first and second portions 134, 136 are attachable to each other in front of a person (not shown) wearing the brassiere 110.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A brassiere comprising:

a. a pair of cups, each of the cups having a first strap member extending away from the cup, and a hook and loop fastener first portion attached to a distal end of the first strap member;

b. a torso support member having a back panel, a pair of second strap members extending away from the back panel, each of the second strap members having a hook and loop fastener second portion attached to a distal end thereof;

c. the hook and loop fastener first portions being releasably fastenable to the hook and loop fastener second portions;

d. the torso support member further having a pair of side panels extending away from the back panel;

e. the torso support member further having a pair of front panels, each of the front panels extending away from a different one of the side panels, and each of the front panels extending away from a different one of the cups;

f. a first one of the front panels narrowing to form a third strap member;

g. a second one of the front panels narrowing to form a fourth strap member;

h. the third strap member directed toward the second one of the front panels, and the fourth strap member directed toward the first one of the front panels;

i. a second hook and loop fastener first portion attached to a distal end of the third strap member, and a second hook and loop fastener second portion attached to a distal end of the fourth strap member, the second hook and loop fastener first and second portions being releasably fastenable to each other; and j. the third and the fourth strap members being adapted to cross each other and to extend around the torso support member until the second hook and loop fastener first and second portions are attachable to each other behind a person wearing the brassiere.

2. A brassiere comprising:

a. a pair of cups, each of the cups having a first strap member extending away from the cup, and a hook and loop fastener first portion attached to a distal end of the first strap member;

b. a torso support member having a pair of back panels, a pair of second strap members extending away from the back panels, each of the second strap members having a hook and loop fastener second portion attached to a distal end thereof;

c. the hook and loop fastener first portions being releasably fastenable to the hook and loop fastener second portions;

d. the torso support member further having a pair of side panels extending away from the back panels;

e. the torso support member further having a front panel extending between the side panels, and extending away from the cups;

f. a first one of the back panels narrowing to form a third strap member;

g. a second one of the back panels narrowing to form a fourth strap member;

h. the third strap member directed toward the second one of the back panels, and the fourth strap member directed toward the first one of the back panels;

i. a second hook and loop fastener first portion attached to a distal end of the third strap member, and a second hook and loop fastener second portion attached to a distal end of the fourth strap member, the second hook and loop fastener first and second portions being releasably fastenable to each other; and j. the third and the fourth strap members being adapted to cross each other and to extend around the torso support member until the second hook and loop fastener first and second portions are attachable to each other in front of a person wearing the brassiere.

3. A brassiere comprising:

a. a pair of cups, each of the cups having a first strap member extending away from the cup, and a fastener first portion attached to a distal end of the first strap member;

b. a torso support member having a first panel, a pair of second strap members extending away from the first panel, each of the second strap members having a fastener second portion attached to a distal end thereof;

c. the fastener first portions being releasably fastenable to the fastener second portions;

d. the torso support member further having a pair of side panels extending away from the first panel;

e. the torso support member further having a pair of second panels, each of the second panels extending away from a different one of the side panels, and each of the second panels extending away from a different one of the cups;

f. a first one of the second panels narrowing to form a third strap member;

g. a second one of the second panels narrowing to form a fourth strap member;

h. the third strap member directed toward the second one of the second panels, and the fourth strap member directed toward the first one of the second panels;

i. a second fastener first portion attached to a distal end of the third strap member, and a second fastener second portion attached to a distal end of the fourth strap member, the second fastener first and second portions being releasably fastenable to each other; and j. the third and the fourth strap members being adapted to cross each other and to extend around the torso support member until the second fastener first and second portions are attachable to each other adjacent the first panel to secure the brassiere to a person wearing the brassiere.

* * * * *